US009108209B2

(12) United States Patent
Lawhorn

(10) Patent No.: US 9,108,209 B2
(45) Date of Patent: Aug. 18, 2015

(54) SPRINKLER SYSTEM WITH BLOWOUT FEATURE

(71) Applicant: Mark Lawhorn, London, OH (US)

(72) Inventor: Mark Lawhorn, London, OH (US)

( * ) Notice: Subject to any disclaimer, the term of this patent is extended or adjusted under 35 U.S.C. 154(b) by 0 days.

(21) Appl. No.: 14/499,496

(22) Filed: Sep. 29, 2014

(65) Prior Publication Data

US 2015/0097052 A1 Apr. 9, 2015

Related U.S. Application Data

(60) Provisional application No. 61/887,022, filed on Oct. 4, 2013.

(51) Int. Cl.
*B05B 15/02* (2006.01)
*B08B 9/032* (2006.01)

(52) U.S. Cl.
CPC ..... *B05B 15/02* (2013.01); *B08B 9/0328* (2013.01); *B05B 15/025* (2013.01)

(58) Field of Classification Search
CPC .. B05B 15/02; B05B 15/0208; B05B 15/025; B05B 15/0266; B08B 9/0321; B08B 9/0328; A01G 25/02; A01G 25/16
See application file for complete search history.

(56) References Cited

U.S. PATENT DOCUMENTS

| | | | | |
|---|---|---|---|---|
| 4,174,067 | A * | 11/1979 | Watanabe et al. | 239/112 |
| 5,355,905 | A * | 10/1994 | Burgess et al. | 137/1 |
| 5,413,134 | A * | 5/1995 | Burgess et al. | 137/1 |
| 5,857,480 | A * | 1/1999 | Klein | 137/209 |
| 2005/0217062 | A1 * | 10/2005 | Field et al. | 15/320 |
| 2008/0302882 | A1 * | 12/2008 | Rosselli et al. | 239/1 |
| 2011/0079654 | A1 * | 4/2011 | Bailey et al. | 239/1 |
| 2012/0325923 | A1 * | 12/2012 | Hartfelder et al. | 239/1 |
| 2013/0220437 | A1 * | 8/2013 | Dean et al. | 137/15.04 |
| 2014/0261734 | A1 * | 9/2014 | Dunn | 137/15.05 |

* cited by examiner

*Primary Examiner* — Darren W Gorman
(74) *Attorney, Agent, or Firm* — Standley Law Group LLP

(57) ABSTRACT

A sprinkler system and sprinkler system module having a blowout subsystem for automatically clearing a sprinkler feed pipe of water, and also without first needing to bleed off system pressure.

9 Claims, 1 Drawing Sheet

SPRINKLER LATERAL PIPE FEEDS

SPRINKLER SYSTEM WITH BLOWOUT FEATURE

CROSS-REFERENCE TO RELATED APPLICATIONS

This application claims priority to U.S. Provisional Patent Application No. 61/887,022 filed 4 Oct. 2013, the content of which is hereby incorporated by reference as if fully recited herein.

TECHNICAL FIELD

The present invention is directed generally to mechanical systems, and more particularly to a sprinkler system having an automatic blowout feature.

BACKGROUND OF THE INVENTION

Generally, sprinkler systems are used in a wide variety of applications, both indoor and outdoor. The installation and use of sprinkler systems outdoors presents a difficulty in environments in which the ambient temperature reaches below the freezing point. In those circumstances, the plumbing of the sprinkler systems must be cleared, or "blown out," in order to prevent damage to the pipes, fittings and other elements of the system due to the expansion and contraction of water/ice. Typically, a sprinkler system blowout occurs in two steps. First, the water in and around the plumbing near the system's water inlet is drained as the system pressure is bled. Next, a source of pressurized air is coupled to the sprinkler system plumbing and actuated, forcing the remaining water throughout the plumbing through the sprinkler system outlets at the various sprinkler head locations, thereby draining the system in preparation of freezing temperatures.

Where sprinkler use during cold seasons is not needed, the sprinkler systems are often blown out once before cold weather sets in. However, there are presently many uses for sprinkler systems that require consistent, repeated sprinkler system use, even during cold weather. For example, in several industries involving the care, sale, showing, competition and service of livestock, the groundcover utilized in both indoor and outdoor spaces often consists of mixtures of sand, soil, sawdust and other particulate that can become dry and powdery. When these substances are in such a dry state they can easily get stirred up by livestock movement, thereby becoming airborne.

The need to keep groundcover damp is especially strong in the horse showing and competition industry. While any type of livestock or other "show" animals—including cattle, sheep, dogs and the like—that exist or experience similar conditions will benefit from the present invention, many indoor and outdoor arenas now exist in which horses are ridden for recreation, performance or competitive purposes. Horse performance or practice arenas will be used to illustrate the many benefits and advantages of the present invention, but applications thereof need not be limited to that. Practicing or performing on horseback in an indoor or outdoor arena occurs on a daily basis throughout the country. In order to keep the dust down and prevent it from becoming airborne, arena owners first began to periodically spray a light mist of water from a garden hose attached to a water source. Such methods, however, proved to be time consuming and burdensome, as someone was forced to drag a hose around the arena. It was also inefficient because of the uneven application of water, and sometimes even ineffective.

To overcome these problems, many arenas began installing overhead sprinkler systems, similar to those installed for fire prevention inside commercial buildings, or in the lawns and gardens of residential homes. Some systems are programmed to cycle on and off periodically to keep the groundcover at a particular level of dampness. Many systems now typically utilize controllers—for example those produced under the popular Hunter brand—to set the sprinkler systems to actuate automatically at preprogrammed time intervals. However, for outdoor and unheated indoor arenas in cold climates, the sprinkler systems continue to be at risk of freezing. Because many arenas operate year round, the sprinkler systems must be utilized often during winter months. Thus, to avoid damage caused by freezing, the sprinkler systems must be blown out after nearly every use—a significantly arduous task. Furthermore, a failure to blowout a system between uses can easily create significant costs for the arena owners.

Furthermore, the cost of even a seasonal service call to have a sprinkler system blown out in preparation for nonuse during winter months can be significant. However, no prior art systems are available that allow for efficient, automatic blowout of a sprinkler system without the need to prepare the plumbing, attach additional equipment and conduct the blowout.

BRIEF SUMMARY OF THE INVENTION

Exemplary embodiments of the present disclosure pertain to sprinkler systems having a plurality of sprinkler feed pipes each having a plurality of sprinkler heads and an inlet, and further a T fitting for each of the sprinkler feed pipes in the plurality of sprinkler feed pipes. The T fitting is provided with a sprinkler feed pipe outlet, a water supply inlet coupled to a water supply check valve at an outlet of a sprinkler pipe water connection wherein the water supply check valve prevents a flow into the outlet of the sprinkler pipe water connection, and an air supply inlet couple to an air supply check valve at an outlet of a sprinkler pipe air connection wherein the air supply check valve prevents a flow into the outlet of the sprinkler pipe air connection.

Another object of the present invention is to provide a sprinkler system having a sprinkler feed system comprising a sprinkler feed pipe having a plurality of sprinkler heads and an inlet, a water supply subsystem and a blowout subsystem.

The water supply subsystem has a primary water line, which has a water supply inlet wherein an isolation valve couples the primary water line to a water supply and an outlet. The water supply subsystem also has a sprinkler pipe water connection having a distal end, wherein an outlet is coupled to the inlet of the sprinkler feed pipe, a proximal end, wherein an inlet is coupled to the outlet of the primary water line, a valve controlling a flow of water from the primary water line into the inlet of the sprinkler pipe water connection, and a check valve between the outlet and valve of the sprinkler pipe water connection oriented to permit flow from the inlet of the sprinkler pipe water connection to the outlet of the sprinkler pipe water connection.

The blowout subsystem is provided with a primary air line having an air supply inlet wherein an air pressure regulator couples the primary air line to an air supply and an outlet. The blowout subsystem also has a sprinkler pipe air connection having a distal end, wherein an outlet is coupled to the inlet of the sprinkler feed pipe, a proximal end, wherein an inlet is coupled to the outlet of the primary air line, a valve controlling a flow of air from the primary air line into the inlet of the sprinkler pipe air connection and a check valve between the outlet and valve of the sprinkler pipe air connection oriented to permit flow from the inlet of the sprinkler pipe air connection to the outlet of the sprinkler pipe air connection.

Another aspect of the invention is embodied in a sprinkler system blowout module having a water supply subsystem, a blowout supply subsystem, and a module housing whereupon the water supply subsystem and the blowout subsystem are mounted.

These and other advantages are provided by the invention described and shown in more detail below.

BRIEF DESCRIPTION OF THE SEVERAL VIEWS OF THE DRAWINGS

Novel features and advantages of the present invention, in addition to those mentioned above, will become apparent to those skilled in the art from a reading of the following detailed description in conjunction with the accompanying drawings wherein identical reference characters refer to identical parts and in which.

DETAILED DESCRIPTION OF THE INVENTION

Figure 1:
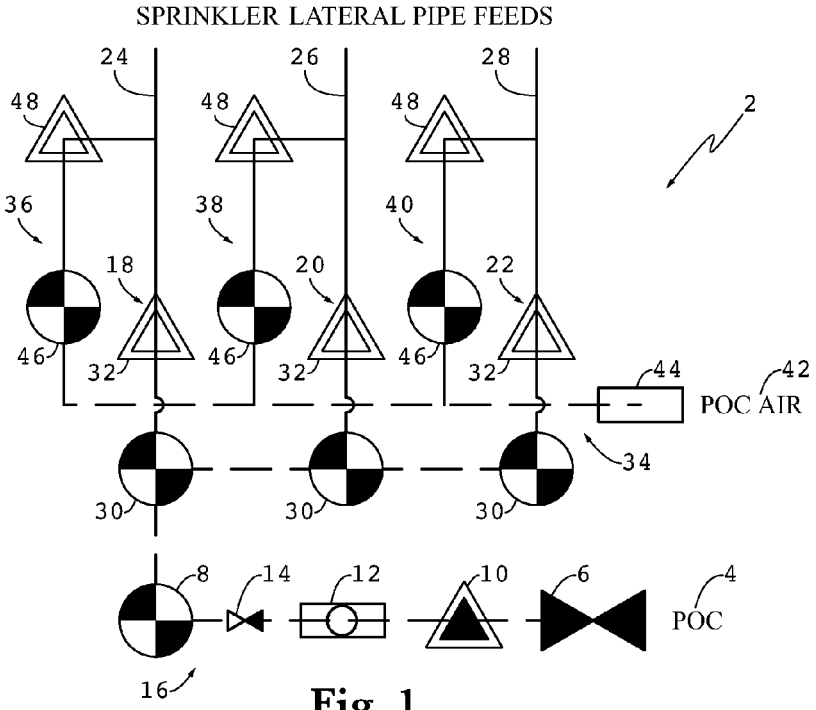
FIG. 1 is a plan view of a schematic diagram of a first exemplary embodiment of the invention.
Figure 2:
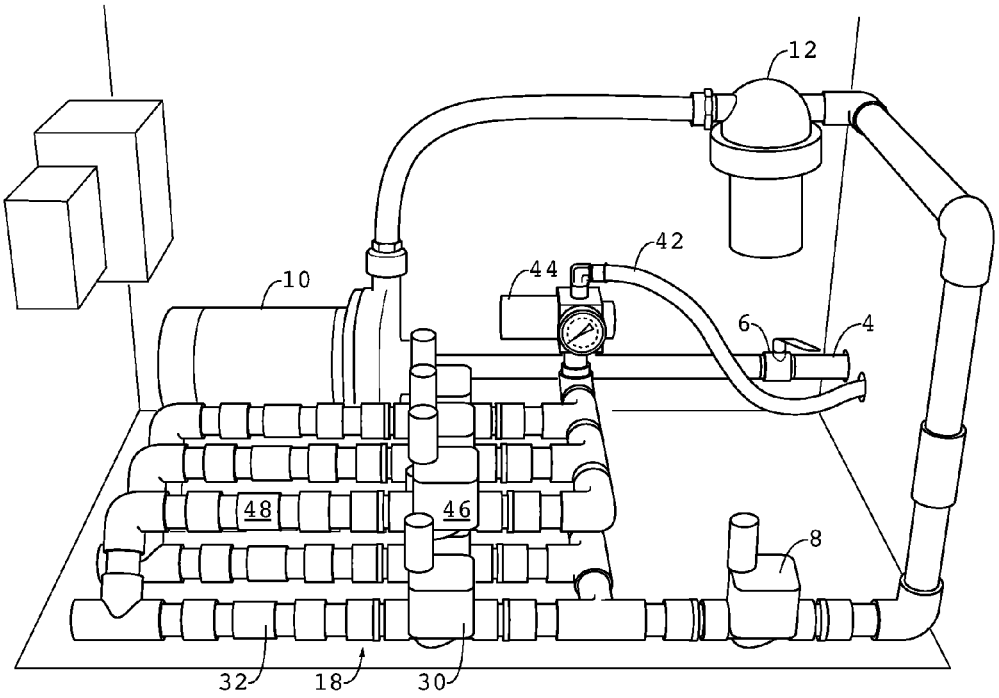
FIG. 2 is a perspective view of a second exemplary embodiment of the invention.

A first embodiment of the invention is shown in schematic format in FIG. 1. A perspective view of a second embodiment of the invention is shown in FIG. 2, and includes many similar elements to the first embodiment. Therefore, the following detailed description will discuss both embodiments together, with like parts having like labels.

The present invention is embodied in sprinkler systems having an automatic blowout feature. The invention may be employed as an entire sprinkler system, or as a blowout module connected and incorporated into the plumbing of an existing sprinkler system. For example, the plumbing of an existing sprinkler system can include a water source, and one or more sprinkler feed pipes that are buried in the ground or attached to overhead features of an indoor or outdoor structure. Sprinkler feed pipes are typically plumbing carrying sprinkler heads along the length of the pipe at locations in which it is desirous to have water emitted from a sprinkler head, and have water inlets at one end. Pressurized water is pumped into the water inlets and out through the sprinkler heads at the desirous locations.

The embodiments in both figures are shown in connection with a sprinkler system having three sprinkler feed pipes. However, any number of sprinkler feed pipes that may be required of a particular application may be used, as those skilled in the art will appreciate. For example, a small yard may require only a single sprinkler feed pipe, whereas a large indoor arena may require many more sprinkler fee pipes. It should be understood that the number of sprinkler feed pipes is not considered to limit the scope of the invention disclosed herein.

In the exemplary embodiments shown, the invention is provided with a point of connection ("POC"), or water supply inlet 4, which is connected to and receives water from a water supply (not shown). It is preferable for an isolation valve 6 to be provided at or near the water supply inlet so that the sprinkler system and water supply may be easily decoupled for maintenance, repair, testing and the like. A two-way valve 8 preferably with flow control is provided to throttle or regulate the water flow coming from the water supply. Other water line components may be provided between the water supply inlet and the two-way valve, such as a booster pump 10 to increase water pressure for larger systems, an inline water filter 12 to remove particulates and debris, and a dual check valve 14 to increase the performance and efficiency of the system. Together, these elements form a primary water line 16.

The primary water line 16 feeds one or more sprinkler pipe water connections coupled thereto in parallel when more than one sprinkler pipe water connection is required. The number of sprinkler pipe water connections should generally equal the number of sprinkler feed pipes required at a particular location, although other designs may be necessary. As discussed previously, the embodiments shown depict the use of three sprinkler pipe water connections—18, 20 and 22—corresponding to three sprinkler feed pipes (the inlets of which are depicted at 24, 26 and 28 in FIG. 1, but are not shown in FIG. 2).

Preferably, each of the sprinkler pipe water connections includes at its inlet a two-way valve with flow control 30 in order to provide sufficient control of the sprinkler system. Each water connection also includes a check valve 32, and preferably a spring check valve or other similar type of inline check valve. The use of a spring type check valve, or other check valve in which higher downstream pressure closes the valve thereby preventing reverse flow, is preferred because the introduction of air into the system by the automatic blowout feature will close the check valves 32 and obviates the need to bleed the system before applying pressurized air. This characteristic creates a substantial time savings and in part allows the automatic blowout feature to occur without manual service.

Together, the primary water line 16 and the one or more sprinkler pipe water connections 18, 20 and 22 make up the water supply subsystem. The water supply subsystem essentially connects a water supply to one or more sprinkler feed pipes.

Also included in the invented sprinkler system is an air supply subsystem. The air supply subsystem similarly includes a primary air line 34 and one or more sprinkler pipe air connections, as at 36, 38 and 40. The primary air line 34 is connected to an air supply (not shown) at an air supply inlet 42, or point of connection, at an air pressure regulator 44. When one or more sprinkler pipe air connections are necessary, such as with 36, 38 and 40, it is preferable to connect each of their inlets to the primary air line 34 outlet in parallel. The coupling of each air connection and the flow of air from the primary air line 34 to the air connections 36, 38 and 40 is controlled by a two-way valve 46. Each of the two-way valves 46 may be controlled together to regulate air flow between multiple air connections. Near the outlet of each air connection is a check valve 48 that isolates the air connections from the water connection and sprinkler feed pipes until high pressure air from the air supply is applied to clear out the sprinkler feed pipes. The application of such high pressure air closes the water connection check valves 32 thereby preventing the need to bleed the system prior to blowout.

Furthermore, the invention may be supplied as a blowout module, supplied either with or without a controller. For example, the embodiment shown in connection with FIG. 2 may be mounted in a case, box, tray, board or other such housings, intended for mounting on the wall in an arena, barn, garage, or other such structure. Controllers may be off the shelf and provided by the user of the invention, for example by purchasing and using a popular Hunter brand controller.

Including the blowout feature components as a kit also allows for existing sprinkler plumbing systems, controls and water supplies to be fitted with a blowout module. For example, the module can be mounted on a wall, connected to an automatic air compressor and an existing water supply, and the sprinkler pipe water and air connections connected to existing sprinkler feed pipes that are already installed on a premises.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain some of the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A sprinkler system comprising:

a plurality of sprinkler feed pipes each having a plurality of sprinkler heads and an inlet; and a T fitting for each of the sprinkler feed pipes in the plurality of sprinkler feed pipes comprising:

a sprinkler feed pipe outlet;

a water supply inlet coupled to a water supply check valve at an outlet of a sprinkler pipe water connection wherein the water supply check valve prevents a flow into the outlet of the sprinkler pipe water connection; and an air supply inlet coupled to an air supply check valve at an outlet of a sprinkler pipe air connection wherein the air supply check valve prevents a flow into the outlet of the sprinkler pipe air connection.

2. A sprinkler system comprising:

a sprinkler feed system comprising a sprinkler feed pipe having a plurality of sprinkler heads and an inlet;

a water supply subsystem comprising:

a primary water line comprising:

a water supply inlet wherein an isolation valve couples the primary water line to a water supply; and an outlet; and a sprinkler pipe water connection comprising:

a distal end, wherein an outlet is coupled to the inlet of the sprinkler feed pipe;

a proximal end, wherein an inlet is coupled to the outlet of the primary water line;

a valve controlling a flow of water from the primary water line into the inlet of the sprinkler pipe water connection; and a check valve between the outlet and valve of the sprinkler pipe water connection oriented to permit flow from the inlet of the sprinkler pipe water connection to the outlet of the sprinkler pipe water connection; and a blowout subsystem comprising:

a primary air line comprising:

an air supply inlet wherein an air pressure regulator couples the primary air line to an air supply; and an outlet; and a sprinkler pipe air connection comprising:

a distal end, wherein an outlet is coupled to the inlet of the sprinkler feed pipe;

a proximal end, wherein an inlet is coupled to the outlet of the primary air line;

a valve controlling a flow of air from the primary air line into the inlet of the sprinkler pipe air connection; and a check valve between the outlet and valve of the sprinkler pipe air connection oriented to permit flow from the inlet of the sprinkler pipe air connection to the outlet of the sprinkler pipe air connection.

3. The sprinkler system of claim 2, wherein the primary water line further comprises a booster pump located between the isolation valve and the primary water line outlet.

4. The sprinkler system of claim 2, wherein the primary water line further comprises a water filter located between the isolation valve and the primary water line outlet.

5. The sprinkler system of claim 2, wherein the primary water line further comprises a valve controlling the flow of water out of the primary water line outlet.

6. The sprinkler system of claim 5, wherein the primary water line further comprises a dual check valve located between the isolation valve and the primary water line valve.

7. A sprinkler system blowout module comprising:

a water supply subsystem comprising:

a primary water line comprising:

a water supply inlet;

an isolation valve; and an outlet; and a sprinkler pipe water connection comprising:

a distal end having an outlet for coupling to a sprinkler feed pipe inlet;

a proximal end, wherein an inlet is coupled to the outlet of the primary water line;

a valve controlling a flow of water from the primary water line into the inlet of the sprinkler pipe water connection; and a check valve between the outlet and valve of the sprinkler pipe water connection oriented to permit flow from the inlet of the sprinkler pipe water connection to the outlet of the sprinkler pipe water connection; and a blowout subsystem comprising:

a primary air line comprising:

an air supply inlet at an air pressure regulator; and an outlet; and a sprinkler pipe air connection comprising:

a distal end having an outlet for coupling to a sprinkler feed pipe inlet;

a proximal end, wherein an inlet is coupled to the outlet of the primary air line;

a valve controlling a flow of air from the primary air line into the inlet of the sprinkler pipe air connection; and a check valve between the outlet and valve of the sprinkler pipe air connection oriented to permit flow from the inlet of the sprinkler pipe air connection to the outlet of the sprinkler pipe air connection;

a module housing whereupon the water supply subsystem and the blowout subsystem are mounted.

8. The sprinkler system blowout module of claim 7, wherein the module housing is mountable upon a wall.

9. The sprinkler system blowout module of claim 8, further comprising a controller adapted to receive instructions for automatically actuating the blowout subsystem.

* * * * *